US008640895B2

(12) United States Patent
Pleuss et al.

(10) Patent No.: US 8,640,895 B2
(45) Date of Patent: Feb. 4, 2014

(54) DRUM TENSIONING METHOD AND APPARATUS FOR LOAD HOIST WIRE ROPE

(75) Inventors: Alan E. Pleuss, Manitowoc, WI (US); Terry S. Casavant, Two Rivers, WI (US); Paul M. Pukita, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 623 days.

(21) Appl. No.: 12/844,643

(22) Filed: Jul. 27, 2010

(65) Prior Publication Data

US 2011/0024378 A1 Feb. 3, 2011

Related U.S. Application Data

(60) Provisional application No. 61/229,164, filed on Jul. 28, 2009.

(51) Int. Cl.
*B66C 13/16* (2006.01)

(52) U.S. Cl.
USPC ..... 212/276; 212/270

(58) Field of Classification Search
USPC ..... 212/276, 281, 270, 308; 254/278
See application file for complete search history.

(56) References Cited

U.S. PATENT DOCUMENTS

| | | | | |
|---|---|---|---|---|
| 1,092,670 A | | 4/1914 | Smith | |
| 1,575,142 A | | 3/1926 | Wilson et al. | |
| 1,958,037 A | | 5/1934 | Engler | |
| 3,912,093 A | * | 10/1975 | Kruschke | 414/542 |
| 4,168,781 A | | 9/1979 | Bryan, Jr. | |
| 5,114,026 A | * | 5/1992 | Van Ketel Hendrik | 212/308 |
| 5,189,605 A | * | 2/1993 | Zuehlke et al. | 701/50 |
| 6,113,023 A | | 9/2000 | Ueffing et al. | |

(Continued)

FOREIGN PATENT DOCUMENTS

| | | |
|---|---|---|
| CN | 201116268 Y | 9/2008 |
| DE | 203 19 073 U1 | 4/2005 |

(Continued)

OTHER PUBLICATIONS

Python Hight Performance Wire Rope, 2004, Unirope Limited, Obtained online at www.westcovan.com-catalogs-pythonrope.*

(Continued)

*Primary Examiner* — William E Dondero
*Assistant Examiner* — Nathaniel Adams
(74) *Attorney, Agent, or Firm* — Steven P. Shurtz; Brinks Gilson & Lione

(57) ABSTRACT

A drum tensioning method is provided for operating a crane having a continuously reeved load hoist line, with a first end of the load hoist line connected to a first drum and a second end of the load hoist line connected to a second drum, with the load hoist line reeved through boom sheaves and a hook block. The method includes the steps of applying a hold-back force to the second drum; applying a winding force to the first drum greater than the hold back force on the second drum; and applying the winding and hold back forces while limiting movement of the hook block, thereby spooling the load hoist line from the second drum through the boom sheaves and hook block to the first drum while maintaining tension in the load hoist line such that the load hoist line is wound under more tension on the first drum than it had previously been wound on the second drum.

20 Claims, 8 Drawing Sheets

(56) References Cited

U.S. PATENT DOCUMENTS

| | | | | |
|---|---|---|---|---|
| 6,758,356 | B1 | 7/2004 | Zuehlke et al. | |
| 7,097,155 | B2 * | 8/2006 | Jackson et al. | 254/276 |
| 2007/0290182 | A1 * | 12/2007 | Noeske et al. | 254/327 |
| 2008/0116161 | A1 | 5/2008 | Kurotsu et al. | |
| 2008/0121602 | A1 | 5/2008 | Zhang | |

FOREIGN PATENT DOCUMENTS

| | | | |
|---|---|---|---|
| DE | 20 2004 017 990 | U1 | 3/2006 |
| EP | 0 312 336 | A1 | 10/1988 |
| GB | 1 339 131 | A | 5/1970 |
| JP | 4-72296 | A | 3/1992 |
| JP | 7 144887 | A | 6/1995 |
| WO | WO 2006/013053 | A1 | 2/2006 |

OTHER PUBLICATIONS

Dalrymple, Will, "Lowering problems hit large cranes," www.cranestodaymagazine.com, *Cranes Today* 41-42 (Sep. 2008).

* cited by examiner

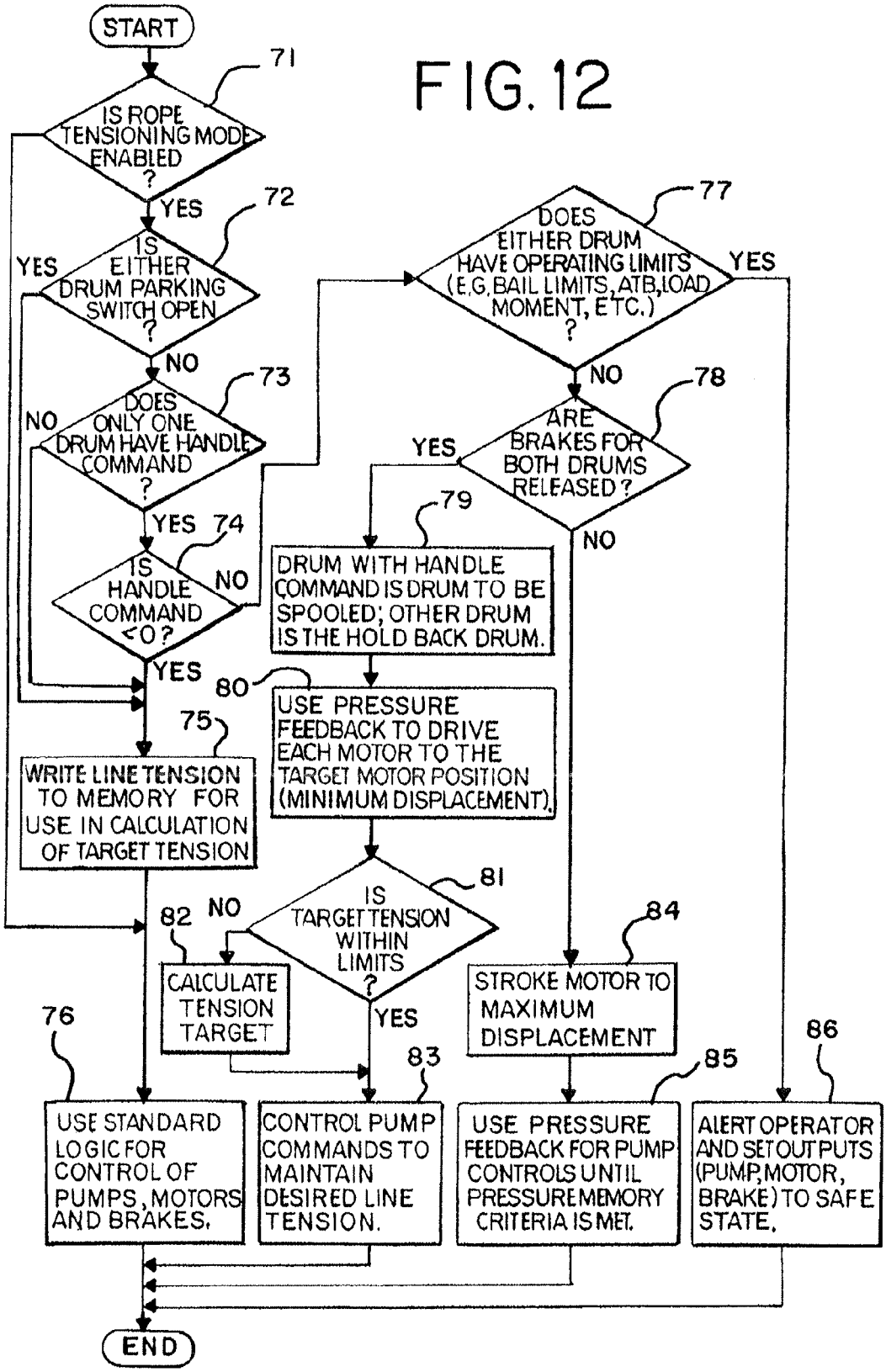
FIG. 12
START
71
IS ROPE TENSIONING MODE ENABLED ?
YES
72
IS EITHER DRUM PARKING SWITCH OPEN ?
YES
NO
73
DOES ONLY ONE DRUM HAVE HANDLE COMMAND ?
NO
YES
74
IS HANDLE COMMAND <0 ?
NO
YES
75
WRITE LINE TENSION TO MEMORY FOR USE IN CALCULATION OF TARGET TENSION
76
USE STANDARD LOGIC FOR CONTROL OF PUMPS, MOTORS AND BRAKES.
77
DOES EITHER DRUM HAVE OPERATING LIMITS (E.G. BAIL LIMITS, ATB, LOAD MOMENT, ETC.) ?
YES
NO
78
ARE BRAKES FOR BOTH DRUMS RELEASED ?
YES
NO
79
DRUM WITH HANDLE COMMAND IS DRUM TO BE SPOOLED; OTHER DRUM IS THE HOLD BACK DRUM.
80
USE PRESSURE FEEDBACK TO DRIVE EACH MOTOR TO THE TARGET MOTOR POSITION (MINIMUM DISPLACEMENT).
81
IS TARGET TENSION WITHIN LIMITS ?
NO
YES
82
CALCULATE TENSION TARGET
83
CONTROL PUMP COMMANDS TO MAINTAIN DESIRED LINE TENSION.
84
STROKE MOTOR TO MAXIMUM DISPLACEMENT
85
USE PRESSURE FEEDBACK FOR PUMP CONTROLS UNTIL PRESSURE MEMORY CRITERIA IS MET.
86
ALERT OPERATOR AND SET OUTPUTS (PUMP, MOTOR, BRAKE) TO SAFE STATE.
END

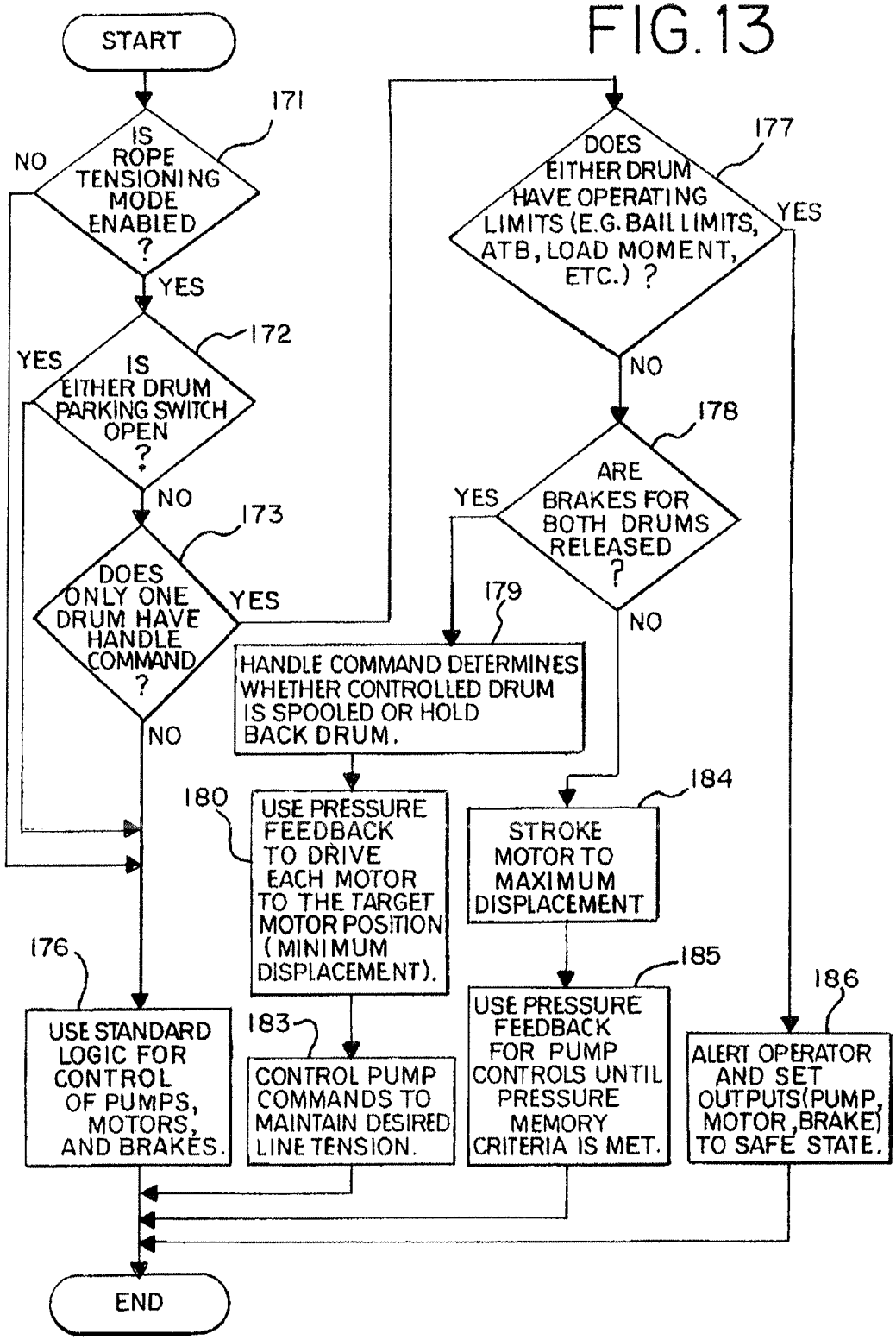
FIG. 13
START
171
IS ROPE TENSIONING MODE ENABLED ?
NO
YES
172
IS EITHER DRUM PARKING SWITCH OPEN ?
YES
NO
173
DOES ONLY ONE DRUM HAVE HANDLE COMMAND ?
YES
NO
176
USE STANDARD LOGIC FOR CONTROL OF PUMPS, MOTORS, AND BRAKES.
177
DOES EITHER DRUM HAVE OPERATING LIMITS (E.G. BAIL LIMITS, ATB, LOAD MOMENT, ETC.) ?
YES
NO
178
ARE BRAKES FOR BOTH DRUMS RELEASED ?
YES
NO
179
HANDLE COMMAND DETERMINES WHETHER CONTROLLED DRUM IS SPOOLED OR HOLD BACK DRUM.
180
USE PRESSURE FEEDBACK TO DRIVE EACH MOTOR TO THE TARGET MOTOR POSITION (MINIMUM DISPLACEMENT).
183
CONTROL PUMP COMMANDS TO MAINTAIN DESIRED LINE TENSION.
184
STROKE MOTOR TO MAXIMUM DISPLACEMENT
185
USE PRESSURE FEEDBACK FOR PUMP CONTROLS UNTIL PRESSURE MEMORY CRITERIA IS MET.
186
ALERT OPERATOR AND SET OUTPUTS (PUMP, MOTOR, BRAKE) TO SAFE STATE.
END

DRUM TENSIONING METHOD AND APPARATUS FOR LOAD HOIST WIRE ROPE

RELATED APPLICATION

The present application claims the benefit under 35 U.S.C. §119(e) of Provisional U.S. Patent Application Ser. No. 61/229,164, filed Jul. 28, 2009, which is hereby incorporated by reference in its entirety.

BACKGROUND

The present invention relates to a method and apparatus for tensioning wire rope while used as a load hoist line on a crane.

The most common use of a crane is to lift objects from ground level to an elevated position. When lifting from the ground, the total crane load is the sum of the weights of the object, the rigging between the hook block and object, the hook block, and the wire rope below the boom top. The weight summation divided by the parts of load hoist line equals the load hoist average line pull. The load hoist lead line pull, which is the actual tension in the load hoist line at the drum, is slightly higher than the average line pull, due to friction and other small inefficiencies in the sheaves. When an object is lifted, and the rigging is first pulled tight, the weight of the object increases the lead line pull, assuring the load hoist rope spools tightly on the drum as the object is lifted.

Maintaining the proper lead line tension when spooling long lengths of rope has been an ongoing problem. When wire rope is first placed on a drum (either at the factory when a crane is built, or in the field when new line is being installed), the factory or the field installation crew uses a "hold back" device to put tension on the wire rope as it is spooled onto the drum. This assures that the wire rope is tightly spaced on the drum, and when a load is put on the line later, the rope will not cut into the layers below it.

However, some cranes are used to hoist an object where the object ends up at a lower elevation after the lift than at the beginning of the lift. Some typical examples of this is where a crane lets an object down a shaft into a tunnel. Another example is where a piece of equipment needs to be repaired or replaced, and that piece of equipment is at an elevated position compared to where it needs to be moved to, such as is a wind generator assembly, commonly referred to as a nacelle, on a support tower. The nacelle may need to be removed and lowered because of a component failure or to change out the nacelle to a more powerful or more efficient unit. A crane that may be used to pick the nacelle up off its tower and let it down to the ground may be rigged with a 90 meter (295 ft.) main boom plus a 7 meter (23 ft.) extended upper boom point. The hook block may be rigged with six parts of load hoist line. The load hoist wire rope length needed in this situation is 700 meters (2300 ft.). Even if the crane is rigged with the minimum load hoist wire rope length of 700 meters, minimizing the rope spooled on the drum, and thus minimizing the layers of rope on the drum, a typical load hoist drum with 700 meters of wire rope may have six layers of rope.

Considering a hoisting operation where the object is being moved from a higher elevation to a lower elevation, first the hook block and rigging have to be raised while there is only a minimal load hoist lead line pull. If the hook block is raised to a high elevation, the drum has six layers of very loosely spooled rope on it. When the object is attached to the hook block rigging and lifted off of its support, the load hoist lead line pull increases greatly. Spooling problems have been reported in these types of lifts when the object is lowered to the ground. Gaps in the rope on the drum seem to occur near the flanges and at the cross-overs. Rope pulling down into lower layers has also been reported.

Larger diameter rope spools better as long as the last wrap of the layer can fit into the space between the drum flange and the rope already on the drum. The larger the diameter the rope, up to the pitch between the lagging grooves, the tighter the rope is packed on the drum and the less room that is available for gapping. The tight wrapping of the rope also reduces the likelihood of the layer above to cut in when lifting an object. The rope diameter however cannot be too large. If it is larger than the pitch between lagging grooves it will not be able to fit into the lagging properly. Also, the rope deforms (ovalizes) as is it is wrapped around the drum and this increases its effective width on the drum. This increased width may prevent the last wrap from fitting properly onto the drum next to the flange, which will cause the rope to rise up to the next layer early.

Loose rope (installed with low tension) causes spooling problems even on low layers. The loosely spooled layers of load hoist rope cannot support the increased lead line pull. The lead line will force itself down (cut down) through several layers of rope. In the worst case, the lead line is forced under the outer layers. The outer layers then foul the lead line rope and keep it from unspooling. The object is now stuck in the air.

A number of different solutions to the problem of loosely spooled rope have been proposed. If a much larger drum diameter with fewer layers of rope were used, there would be fewer chances for the line to cut into the layers below it. However, this approach may not be practical, especially for large cranes that are designed to be partly disassembled for transportation over the highway between job sites, as those cranes are typically already designed for maximal highway limits. Additionally, a larger drum is more expensive, and increases the size of other components on the crane, making the crane harder to maneuver on the job site.

Other suggestions include efforts to put frictional forces either on the rope itself, or on pulleys that then engage the rope, to increase the rope tension when the hook block is being raised without an object attached to it. Ideas in this category include a traction winch on the crane (rope wraps multiple times around two wheels), and brake blocks or wheels squeezing the rope. Each of these concepts has drawbacks. Engaging a frictional force against the rope adds to the wear on the rope, which in turn reduces the useful life of the rope. Systems that wrap the rope around additional pulleys create more bending in the rope, once again reducing the useful life of the rope, especially where the diameter of the pulleys are small.

Thus it would be a great advantage if a rope tensioning system could be developed that allows a crane on a job site that needs to perform a lift where an object has to be lowered, particularly when using a long rope length, to somehow get the load hoist line tight on the drum before the object is lowered, without adding extra bending motions in the travel path of the rope or engaging the rope with frictional forces.

BRIEF SUMMARY

An apparatus and method have been invented which allow for the rope which will be used to lower an object to be wound on a hoist drum in a tensioned fashion after the hook block has been raised to a point where it is ready to be attached to the object. The crane uses two drums, and the load hoist line is continuously reeved, with opposite ends of a single line attached to the two different drums. After the hook block is raised to the desired position, a hold back force is applied to a first drum (where the line is currently spooled) while the second drum is rotated to spool the line onto the second drum, the hold back force thus applying the proper tension for winding the line tightly on the second drum.

In a first aspect, the invention is a method of operating a crane having a continuously reeved load hoist line, with a first end of the load hoist line connected to a first drum and a second end of the load hoist line connected to a second drum, with the load hoist line reeved through boom sheaves and a hook block, the method comprising a) applying a hold-back force to the second drum; b) applying a winding force to the first drum greater than the hold back force on the second drum; and c) applying said winding and hold back forces while limiting movement of the hook block, thereby spooling the load hoist line from the second drum through the boom sheaves and hook block to the first drum while maintaining tension in the load hoist line such that the load hoist line is wound under more tension on the first drum than it had previously been wound on the second drum.

In a second aspect, the invention is a crane comprising a lowerworks having ground engaging members; upperworks rotatably connected to the lowerworks such that the upperworks can swing with respect to the ground engaging members; a boom pivotally mounted at a first end on the upperworks; a load hoist line connected at a first end of the load hoist line to a first drum on the crane and connected at a second end of the load hoist line to a second drum on the crane, with the load hoist line reeved through sheaves at a second end of the boom and through sheaves in a hook block suspended from the boom; a sensor on the crane that senses a condition that is related to the tension in the load hoist line; a computer processor coupled with the sensor, the computer processor operable to control at least some operations of the crane; and a computer readable storage medium comprising programming code embodied therein operable to be executed by the computer processor to receive signals from the sensor indicating the condition related to the load hoist line tension and to control a winding force applied to the first drum while the load hoist line is spooled from the second drum onto the first drum.

The limitation on the movement of the hook block can be achieved in a number of different ways. One possibility is to attach the hook to the object that will eventually be lifted, but to keep the tension in the load hoist line less than the amount that is needed to lift the object. Another possibility is to connect the hook block to another object, such as a piece of crane counterweight, which may remain on the ground, or may even be lifted slightly off the ground. Alternatively, a winch mounted to the front of a crane could be used to pull down on the hook block. With all of these techniques, the rope can be spooled onto the second drum with less tension than the line pull that will be used when the object is lifted. This low amount of line pull is insufficient to cause the rope to cut in on the rope on the drum from which it is taken. However, the rope is thereafter wound on the first drum under enough tension so that it will be tight on the first drum, from which it will be taken when the object is lowered. That tension allows the rope to be tightly wound on the first drum, so that it does not cut into the underlying layers once the object is lifted. These and other advantages of the invention, as well as the invention itself, will be more easily understood in view of the attached drawings.

BRIEF DESCRIPTION OF THE DRAWINGS

FIG. 12 is a first flow chart showing the major functions in a computer program subroutine that can be used to control a crane as it performs the method of the present invention.

FIG. 13 is a second flow chart showing an alternative set of major functions in a computer program subroutine that can be used to control a crane as it performs the method of the present invention.

DETAILED DESCRIPTION OF THE DRAWINGS AND THE PRESENTLY PREFERRED EMBODIMENTS

Figure 1:
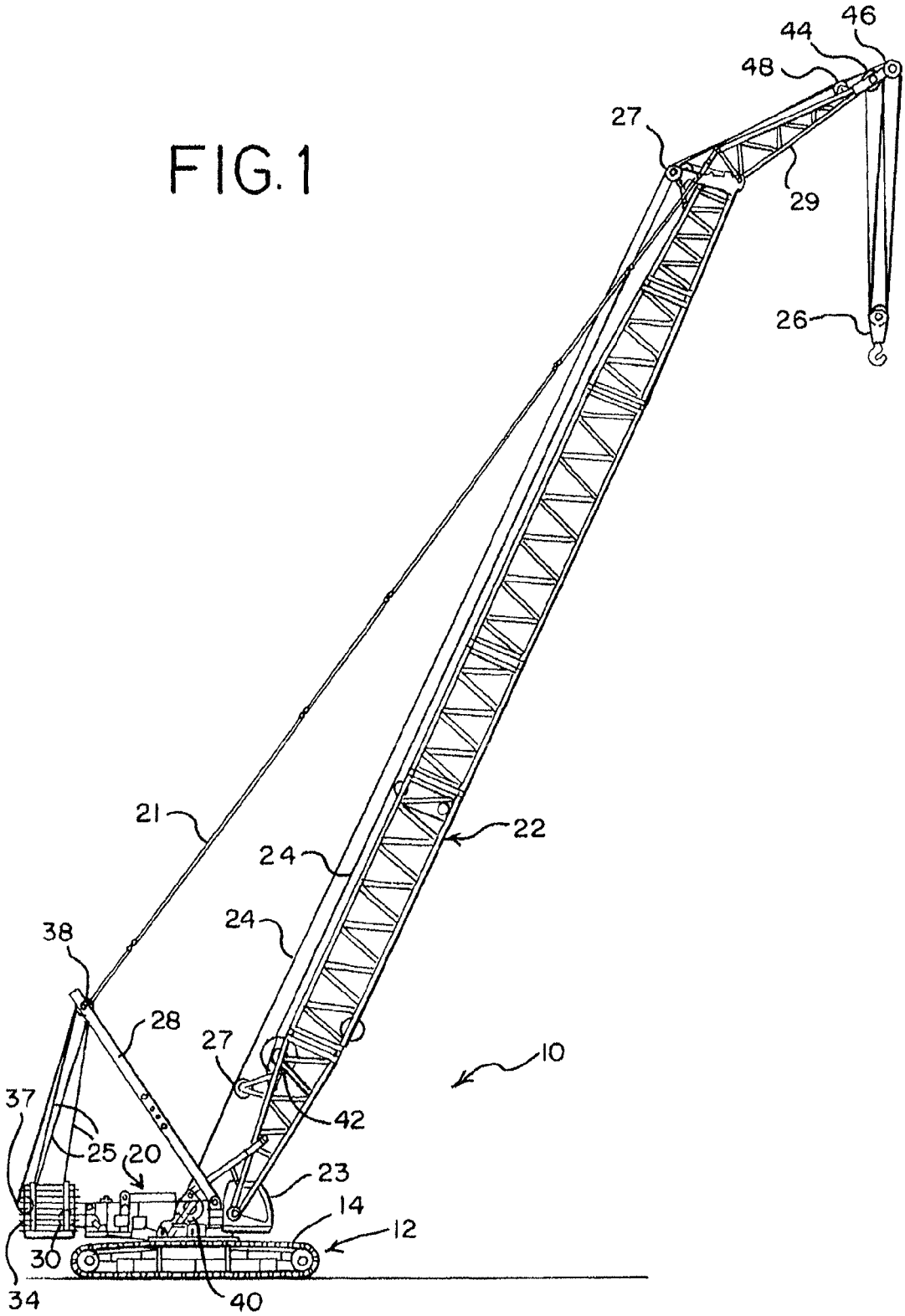
FIG. 1 is a side elevational view of a first embodiment of a mobile lift crane utilizing the drum tensioning apparatus and method of the present invention.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Several terms used in the specification and claims have a meaning defined as follows.

The term "ground engaging member" designates a structure that supports the lower works of a crane. In a mobile lift crane, the ground engaging members are typically crawlers with tracks, or tires. Other cranes may be mounted on pedestal or other fixed structure, in which case the ground engaging members are the portions of the fixed structure secured to the ground. On a barge mounted crane, the sections of the crane securing the crane to the barge are considered ground engaging members for the present invention.

The term "boom top" or "top of boom" designates the portion of the boom that supports the sheaves or pulleys over which the load hoist line passes before being reeved with the hook block. Thus the boom top may include, where used, an upper boom point, an extended upper boom point, a jib (either fixed or luffing) or an intermediate fall. A sheave on an upper boom point that is typically used for a whip line, but in the present invention is used for the continuously reeved load hoist line, is considered part of the boom top. Also, in the phrase "sheaves at a second end of the boom", the second end of the boom is not limited to the extreme end of the boom, but refers to that portion of the boom used to support the sheaves around which a load hoist line are reeved before passing to the hook block. For example, in a tower crane, the trolley moves back and forth on the boom, at the sheaves from which the load hoist line travel down to the hook block may be at any point along the boom.

The term "uniform" in describing a wire rope with a uniform diameter over a given length means that the diameter is uniform within commercially acceptable limits; i.e., a rope that is sold commercially will have small variations in diameter, usually 0% to +5%. Such a wire rope is considered to have a uniform diameter. This is in distinction to a situation where two different wire ropes are connected end to end that have different commercially specified diameters, such as a 28 mm rope connected to an 8 mm rope. Such a connected combination of ropes, even if considered to be one continuous rope, will not have a uniform diameter over the length that includes the joint between the ropes.

The term "elevation" when referring to an object means the position of the bottom of the object when it is suspended, or the bottom of the object when it is resting on the ground or on some other support.

The term "predetermined" in the phrase "predetermined tension range" means a value that is determined before the spooling operation. It may be a value set by an operator. More typically an operator may select a value from a range established by a computer program which takes into consideration the parameters of the crane set up, such as the length of rope on the drums, the size of the drums, the size of the rope and the number of parts of line used in the hook block rigging.

Figure 7:
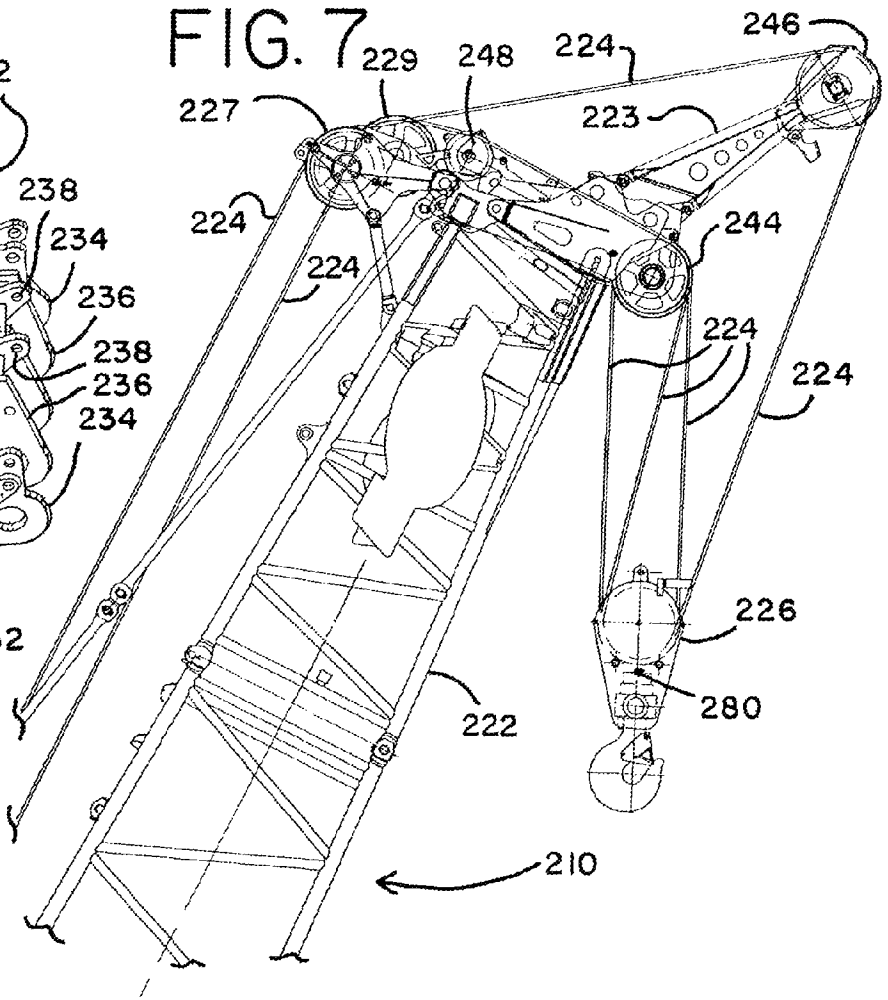
FIG. 7 is a side elevational view of the top portion of the crane of FIG. 6, showing an upper boom point added to the boom top and the hook block rigged.
Figure 9:
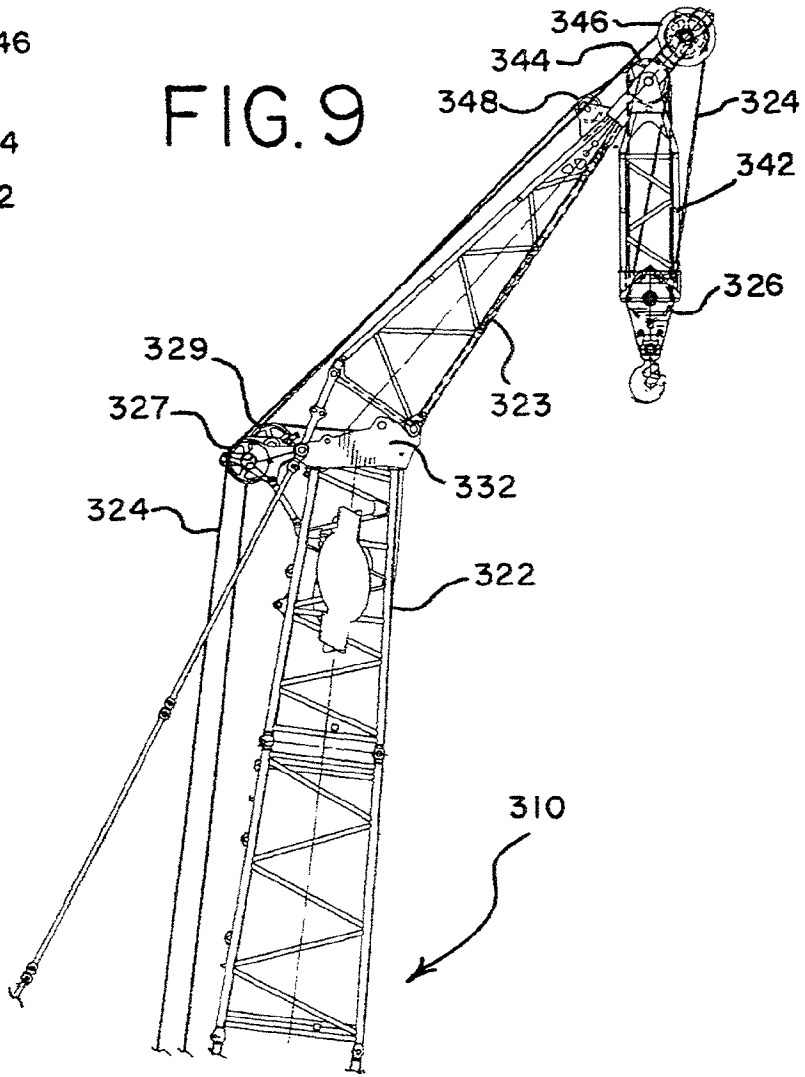
FIG. 9 is side elevational view of the crane of FIG. 8, showing the boom top, extended upper boom point and frame, with the hook block raised to where the boom top and the frame limit further raising of the hook block.
Figure 8:
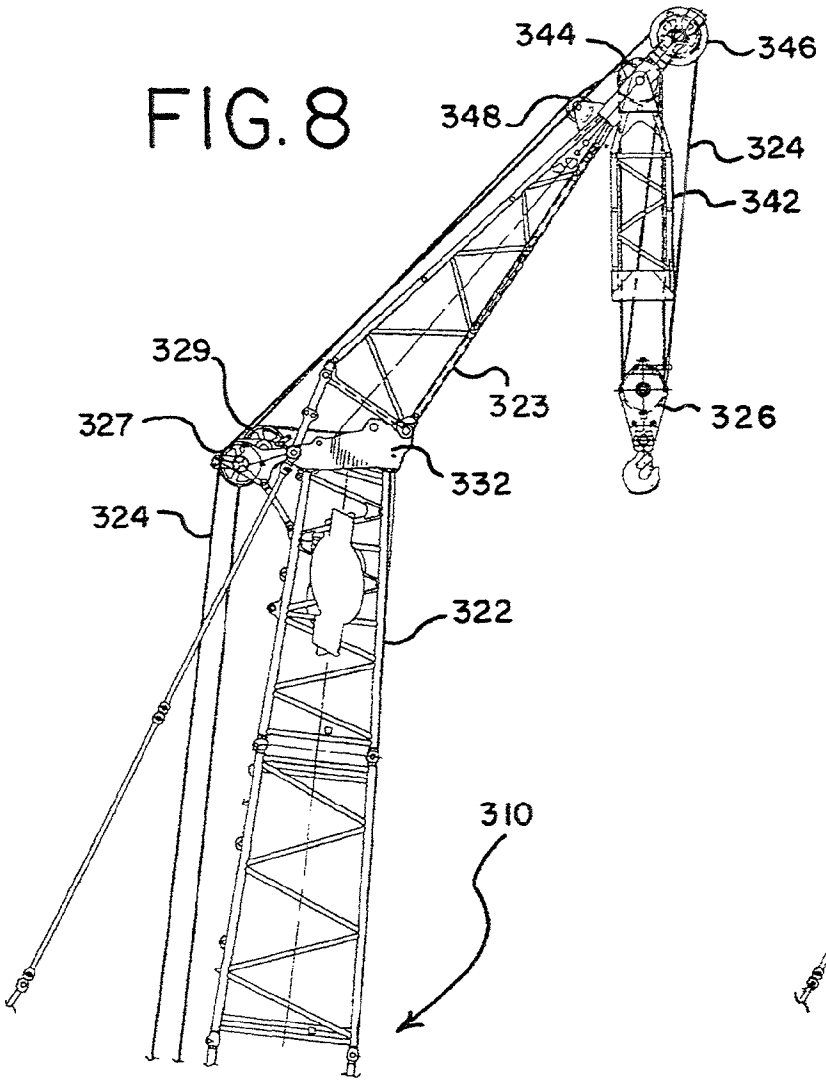
FIG. 8 is a side elevational view of a fourth embodiment of a mobile lift crane utilizing the drum tensioning apparatus and method of the present invention, showing the boom top with an extended upper boom point, and a frame added to fit between the hook block and the boom top.

While the invention will have applicability to many types of cranes, it will be described in connection with a mobile lift crane, shown in the attached drawings with different boom configurations. There are four different configurations of the crane depicted, crane 10 in FIG. 1, crane 110 in FIGS. 2-5, crane 210, portions of which are seen in FIGS. 6-7, and crane 310, portions of which are seen in FIGS. 8-9. Also, it should be noted that some methods of the present invention can be carried out using prior art cranes, as long as they are rigged with continuous reeving. That is one of the advantages of the invention: that it can be carried out without significant modification on many existing cranes. Of course, the method of the invention may be more easily performed with cranes that are modified to include additional features, discussed below.

Crane 10 is shown in an operational configuration in FIG. 1. Like conventional mobile lift cranes, crane 10 includes a lower structure, also referred to as lowerworks, including a carbody 12 and moveable ground engaging members in the form of crawlers 14. There are two crawlers 14, only one of which can be seen from the side view of FIG. 1. In the crane 10, the ground engaging members could include two sets of crawlers, a front and rear crawler on each side. Of course additional crawlers than those shown can be used, as well as other types of ground engaging members, such as tires.

A rotating bed 20 is part of the upper structure, also referred to as the upperworks, of the crane 10 and is rotatably connected to the carbody 12 such that the rotating bed can swing with respect to the ground engaging members. In the crane 10 the rotating bed is mounted to the carbody 12 with a slewing ring that includes a ring gear, such that the rotating bed 20 can swing about an axis with respect to the ground engaging members 14. The rotating bed supports a boom 22 pivotally mounted on a front portion of the rotating bed; a live mast 28 mounted at its first end on the rotating bed; boom hoist rigging connected between the mast and a rear portion of the rotating bed; and a counterweight unit 34. The counterweight may be in the form of multiple stacks of individual counterweight members on a support member.

The boom hoist rigging includes a boom hoist line in the form of wire rope 25 wound on a boom hoist drum 30, and reeved through sheaves on a lower equalizer 37 and an upper equalizer 38. The boom hoist drum is mounted in a frame connected to the rotating bed. The rigging also includes fixed length pendants 21 connected between the boom top and the upper equalizer 38, which is mounted on the top of live mast 28. The lower equalizer 37 is directly connected to the rotating bed 20. This arrangement allows rotation of the boom hoist drum 30 to change the amount of boom hoist line 25 between the lower equalizer 37 and the upper equalizer 38, thereby changing the angle between the rotating bed 20 and the live mast 28, which in turn changes the angle between the rotating bed 20 and the boom 22. Rather than using a live mast 28, the crane could also be equipped with a fixed mast or a derrick mast, with the equalizers then repositioned so as to be able to change the angle between the fixed or derrick mast and the boom. Alternatively, the boom angle could be controlled using a hydraulic cylinder for the boom hoist mechanism.

A load hoist line 24 is wound on a first main load hoist drum 40 connected to the rotating bed. The second end of the load hoist line 24 is wound on second main load hoist drum 42, which is mounted on the boom, and thus indirectly to the rotating bed. The load hoist line 24 passes over rope guides 27 on the boom and is reeved through sheaves at the top of the boom and in the hook block 26. The rotating bed 20 includes other elements commonly found on a mobile lift crane, such as an operator's cab 23. If desired, and as shown in FIG. 1, the boom 22 may comprise an extended upper boom point 29. Alternatively, a luffing jib could be pivotally mounted to the top of the main boom, or other boom configurations may be used. When an extended upper boom point 29 is used, the sheaves through which the load hoist line 24 is reeved at the top of the boom are actually located on the extended upper boom point. Since the load hoist line 24 is continuously reeved, there are two sheave sets 44, 46 at the top of the boom 22 through which the load hoist line 24 is reeved with the sheaves in the hook block 26. However, one of the sheave sets 44, 46 may include only one sheave, which acts as a pulley over which the load hoist line passes at the boom top before traveling to the hook block.

The crane 10 includes two main features that are useful in the preferred method of the invention: 1) a sensor on the crane that senses a condition that is related to the tension in the load hoist line; and 2) a computer processor on the crane, coupled with the sensor, to execute a computer program or other computer-executable code operable to receive signals from the sensor indicating the condition related to the load hoist line tension and to control a winding force applied to one of drums 40, 42 while the load hoist line is spooled from the other drum. Herein, the phrase "coupled with" is defined to mean directly connected to or indirectly connected through one or more intermediate components. Such intermediate components may include mechanical, computer hardware, and computer software based components. The sensor, while not conventionally found on mobile crawler cranes, is not necessarily unique in and of itself. Load hoist line tension sensors are known, and in this regard a sensor of a known type may be used. In the crane 10, according to one embodiment, the sensor comprises a load sensing sheave 48 mounted on the boom top over which the load hoist line 24 passes. The sensor measures the tension in the load hoist line by sensing the compressive force applied to the load sensing sheave by the load hoist line 24. In this regard, the load hoist line is routed from the first drum, over a load sheave, and around the second drum, and the load sheave provides information about the lead line pull.

Computer processors on cranes that control at least some operations of the crane are also known. Such computer processors may be coupled with a computer usable medium having a computer readable program code embodied therein. Computer processors coupled with a sensor, such as a load hoist line tension sensor, are also known. In that regard the present invention once again may use known crane components. However, in the preferred embodiment the program code is operable to be executed by the computer processor to receive the signals from the sensor indicating the condition related to the load hoist line tension and then to control a winding force applied to one of drums 40, 42 while the load hoist line is spooled from the other drum, based on the tension in the load hoist line.

Figure 10:
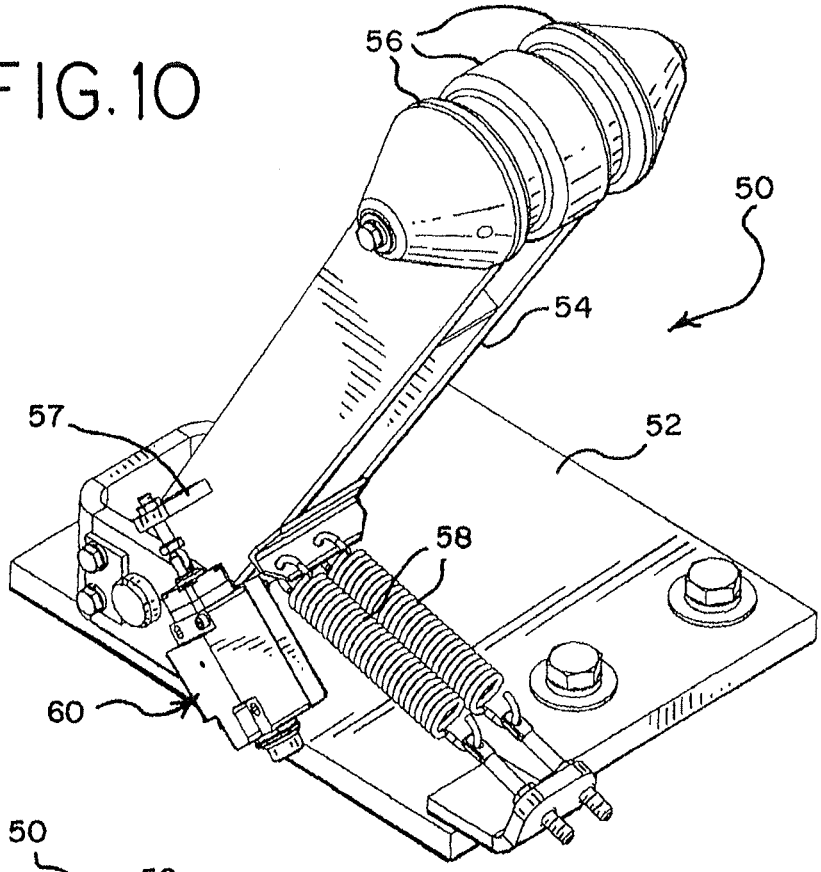
FIG. 10 is a perspective view of a bail limit sensor that can be used with any of the cranes of FIGS. 1-9.
Figure 11:
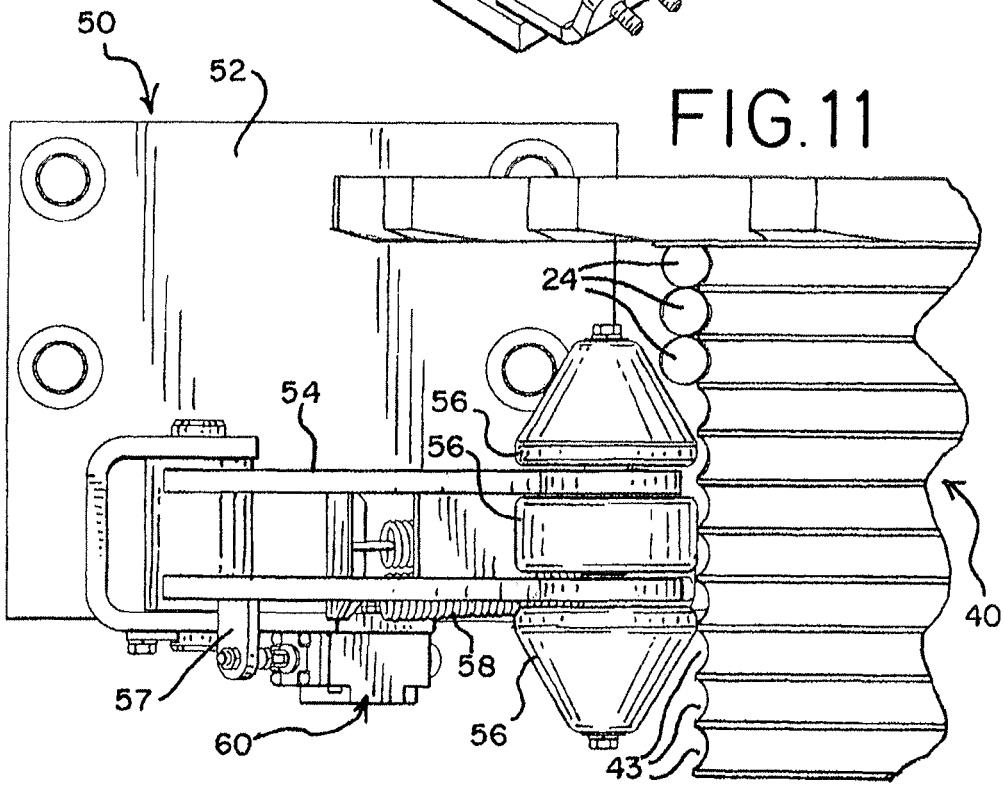
FIG. 11 is a top view of the bail limit sensor of FIG. 10.

There are several other components that are found on crane 10 that are particularly useful with respect to the preferred embodiment of the invention. Preferably the drums 40 and 42 are each equipped with a bail limit sensor. FIGS. 10-11 show an exemplary bail limit sensor assembly 50 that may be used on any of cranes 10, 110 and 210, and is particularly shown in relationship with drum 40 on crane 10. The bail limit sensor assembly 50 can be conventional in its design. The bail limit sensor assembly 50 includes a base plate 52, an arm 54 pivotally mounted to the base plate 52, and rollers 56 rotatably mounted on the end of the arm 54. The base plate 52 mounts the bail limit sensor 50 to the crane in close proximity to the drum 40. Springs 58 mounted between the base plate 52 and the arm 54 hold the rollers 56 in contact with the wire rope 24 on the drum, or the drum itself, as seen in FIG. 11. As wire rope 24 is wound onto the drum, the wire rope will fit in the lagging grooves 43 on the drum 40 and push the rollers 56 away from the drum. Each layer of wire rope 24 will push the rollers 56, and hence the arm 54, further and further away from the drum 40. Of course as wire rope 24 is taken off of drum 40, the rollers 56 and arm 54 can get closer and closer to the drum 40. A sensor 60 is connected between the base plate 52 and an extension 57 on the arm 54 to sense when the last layer of wire rope 24 under the rollers 56 comes off of the drum 40. The sensor 60 includes a limit switch that detects this condition. The bail limit sensor assembly 50 will be placed about three rope diameters inwardly from the side of the drum 40 so that when the last layer of rope 24 comes off the drum 40, and the rollers 56 contact the surface of the drum 40, there will still be at least three, and preferably four, turns of rope 24 on the drum 40. The sensor 60 is coupled to an interface (not shown) in a conventional manner so that the position of the rollers 56 can be used as an input for a computer that uses the bail limit sensor position to help control other functions of the crane. The sensor 60 could alternatively be designed to detect the multiple relative positions of the arm to the base plate, which of course is directly correlated to the number of layers of wire rope 24 on the drum 40, and this information provided to the computer.

The invention is most useful when the drums 40 and 42 each have a diameter and length compared to the length and diameter of the load hoist line such that when the hook block is as close as possible to the boom top, the wire rope is at least three layers deep on one of the drums. The benefit of the invention increases with additional layers, such as six or seven layers on one drum.

The load hoist line 24 preferably comprises wire rope with a uniform diameter throughout its length from its first end connected to drum 40 to its second end connected to drum 42. The load hoist line 24 may comprises wire rope with die-compacted outer strands. The wire rope will typically have a diameter of between about 16 mm and about 50 mm.

The winding force is preferably generated by a hydraulic motor connected to a pressurized source of hydraulic fluid, and the computer readable program code is preferably adapted to be executed to control the pressure of the hydraulic fluid supplied to the hydraulic motor. The embedded crane controls in an on-board computer may be utilized to control the hoist functions based on the control handle input from the operator. The computer may control the hydraulic system by using electric-over-hydraulic controls commonly used in mobile lift cranes, so that, for example, the computer will signal the activation of a solenoid, which opens or closes a pilot valve, which in turn opens or closes another hydraulic valve; or the computer may control the stroke on a hydraulic pump or electronic displacement controls, to control the pressure. Preferably the hold back force on the drum from which the line is being spooled during the tensioning process is also generated by a hydraulic motor connected to a pressurized source of hydraulic fluid, and the computer readable program code is also preferably adapted to be executed to control the pressure of the hydraulic fluid supplied to the hydraulic motor that causes the hold back force. Instead of hydraulic motors, electric motors could also be used to provide the forces on the drums. The computer could then readily be used to control the electrical signals operating such motors. Alternatively, the hold-back force on the second drum is provided by a mechanical brake.

Wire rope manufacturers recommend spooling the rope on the drum with 2% to 5% of the wire rope breaking force. However, sometime the spooling may be done using 1% of the braking force. With a 5 to 1 design safety factor between the rated line pull and the rope breaking force, this will mean that the spooling force should be 5% to 25% of the rated line pull. Since the rated line pull is a known parameter when a crane is set up for a given job, the winding force applied to the first drum is preferably controlled to spool the load hoist line from the second drum onto the first drum with a tension in a predetermined tension range, the predetermined tension range being determined before the winding force is applied. Preferably the predetermined tension range is contained with the range of about 5% and about 25% of the rated line pull of the load hoist line.

The method of present invention will be described in connection with FIGS. 2-5, which show a second embodiment of a crane 110. Crane 110 is the same as crane 10 except that the boom 122 is longer. Crane 110 is shown set up next to a tower 102 used to support a wind turbine. In the depicted method, the load hoist line 124 will be used to lower a wind generator nacelle 104 (the turbine blades already having been removed and not shown). As will be described in more detail, the basic steps of the method include a) applying a hold-back force to the second drum; b) applying a winding force to the first drum greater than the hold back force on the second drum; and c) applying the winding and hold back forces while limiting movement of the hook block, thereby spooling the load hoist line from the second drum through the sheaves in the boom top and hook block to the first drum while maintaining tension in the load hoist line such that the load hoist line is wound under more tension on the first drum than it had previously been wound on the second drum. In the embodiment of the method depicted, the first drum is drum 142 mounted on the boom, and the second drum is drum 140 mounted on the rotating bed. Of course the opposite drums could also be used, with the first drum being drum 140 and the second drum being drum 142.

Figure 2:
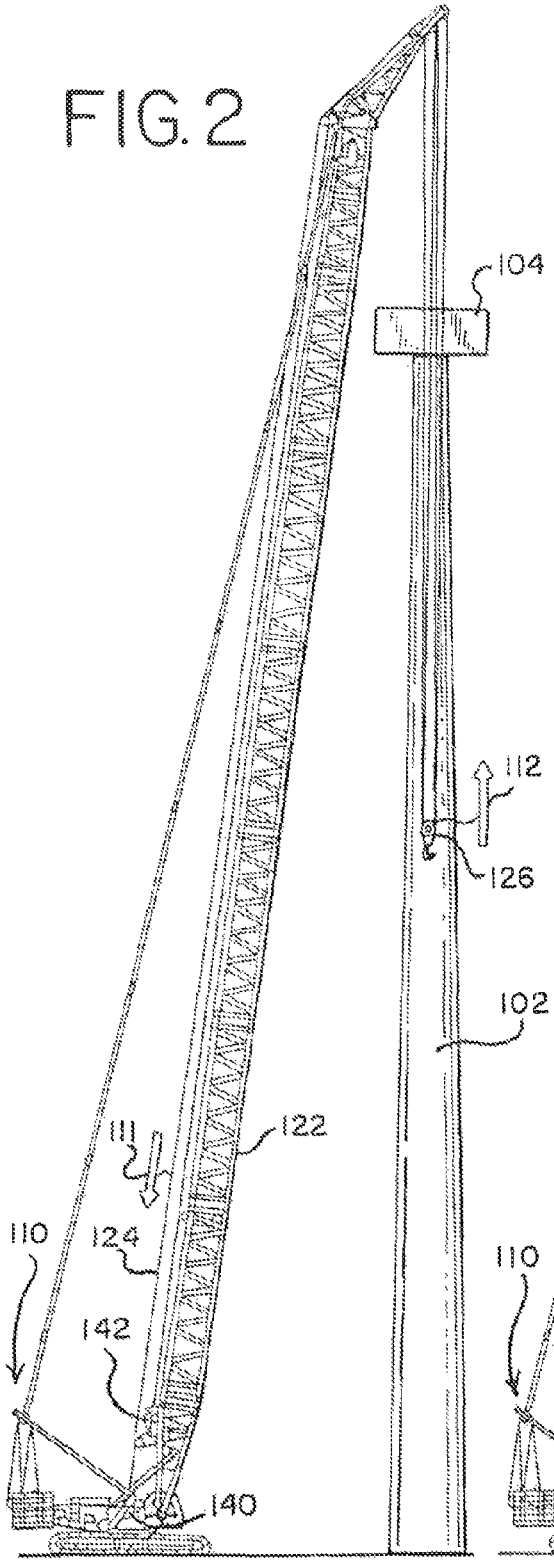
FIG. 2 is a side elevational view of a second embodiment of a mobile lift crane utilizing the drum tensioning apparatus and method of the present invention, showing the hook block being raised to where an object is resting that needs to be lowered.

The preferred procedure includes additional steps besides those enumerated above. The preferred procedure's first step, depicted in FIG. 2, is to raise the hook block 126 and rigging to the desired elevation with drum 140. In this case, the hook block is raised to an elevation at which it can be attached to the object by winding the load hoist line onto the second drum while the hook block has substantially no load on it. Arrow 111 shows load hoist line 124 being taken up by drum 140 and the hook block being raised, depicted by arrow 112. During this first step, drum 142 is preferably held stationary. Preferably the lead line pull resulting from raising the hook block 126 is less than 5% of the rated line pull, more preferably approximately 3% of the rated line pull.

Figure 3:
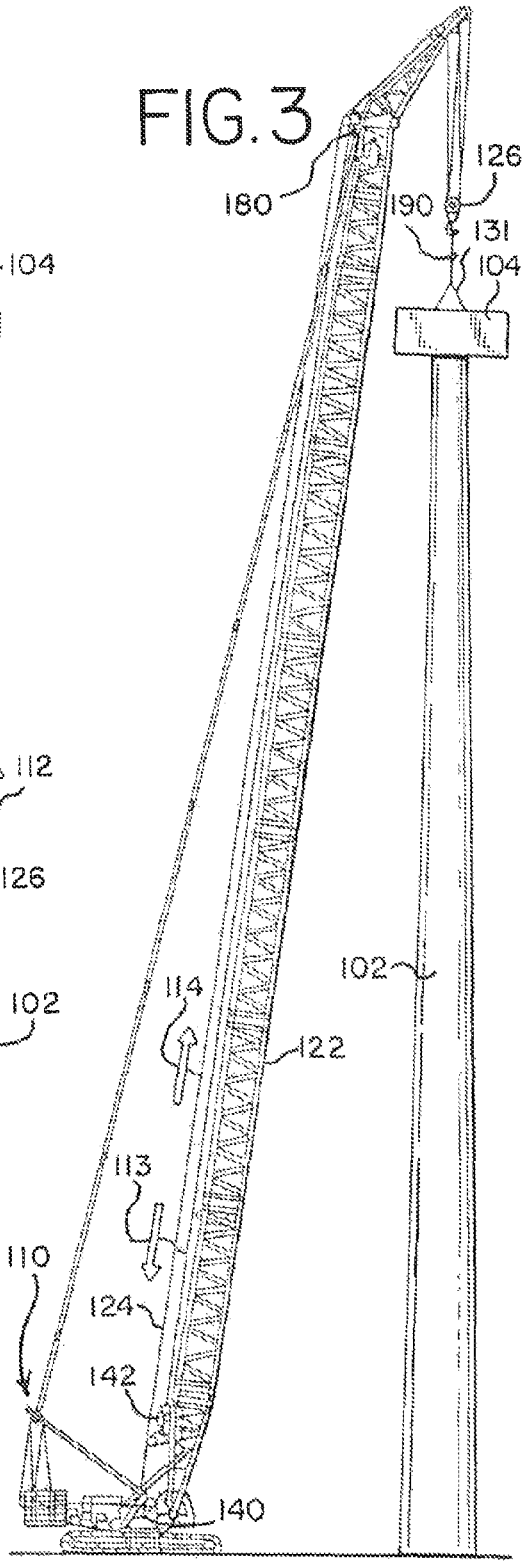
FIG. 3 is a side elevational view of the crane of FIG. 2, showing the hook block attached to the object and the load hoist line being spooled from one drum to another.

As shown in FIG. 3, next the hook block 126 is attached by rigging 131 to the elevated object, in this case, the nacelle 104. Drum 140 continues to pull in the load hoist line 124 until rigging 131 is snugged tight. Now, using drum 140 as a pay-out hold back, rope 124 is spooled onto drum 142. Drum 140 maintains a hold back force such that the lead line pull at drum 142 is between 5% and 25% of the rated line pull while movement of the hook block is limited. The hook block is held in position by being attached to the object which will eventually be lifted, in this case the elevated nacelle 104. It will be appreciated that during this operation, the total force from the two drums 140 and 142 is insufficient to lift the nacelle 104. Arrow 113 depicts the load hoist line 124 being pulled onto drum 142, while arrow 114 shows that the load hoist line 124 is pulled off of drum 140.

Figure 4:
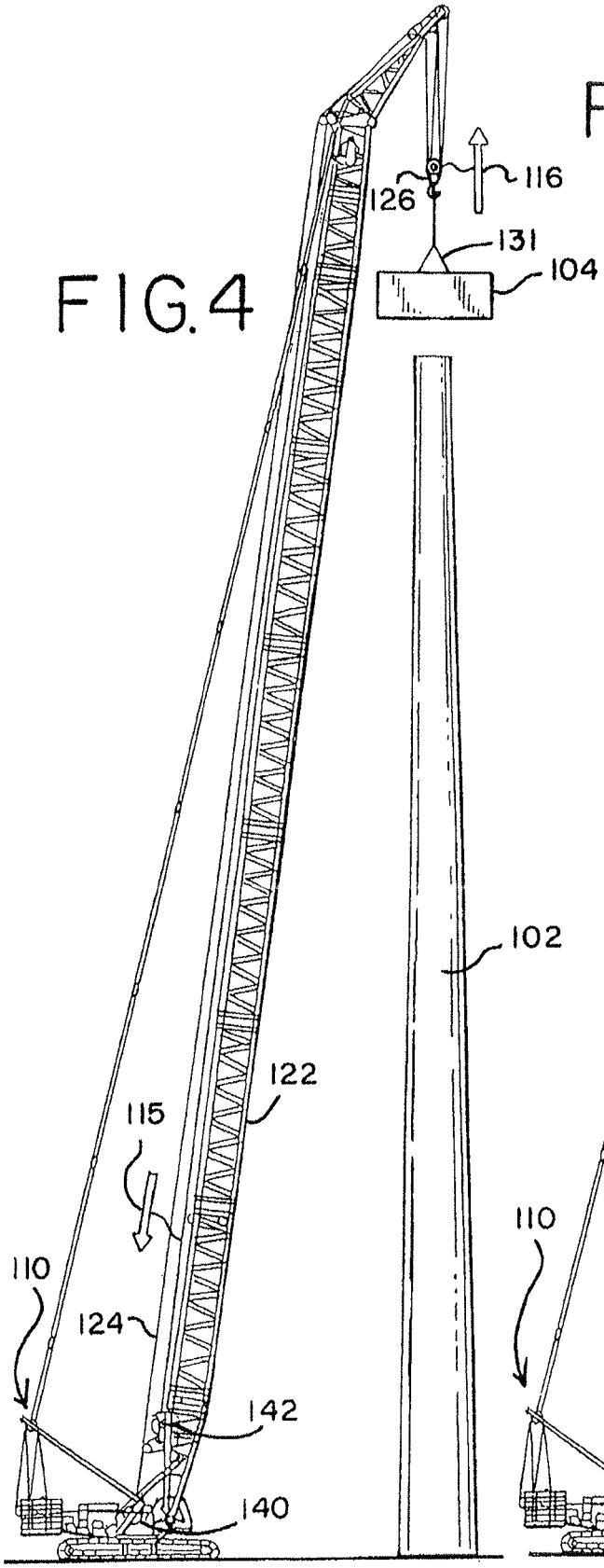
FIG. 4 is a side elevational view of the crane of FIG. 2, showing the hook block attached to the object and the object being raised off of its support.

As shown in FIG. 4, with the rope now tightly spooled onto drum 142, the elevated nacelle 104 can be lifted off the support 102. Arrow 116 shows the hook block being raised. In the depicted method, this is accomplished by winding load hoist line 124 onto drum 142, as depicted by arrow 115. Thus the object is lifted by winding load hoist line onto the first drum. Alternatively the second drum, or both drums simultaneously, could be used to lift the object in this step.

Figure 5:
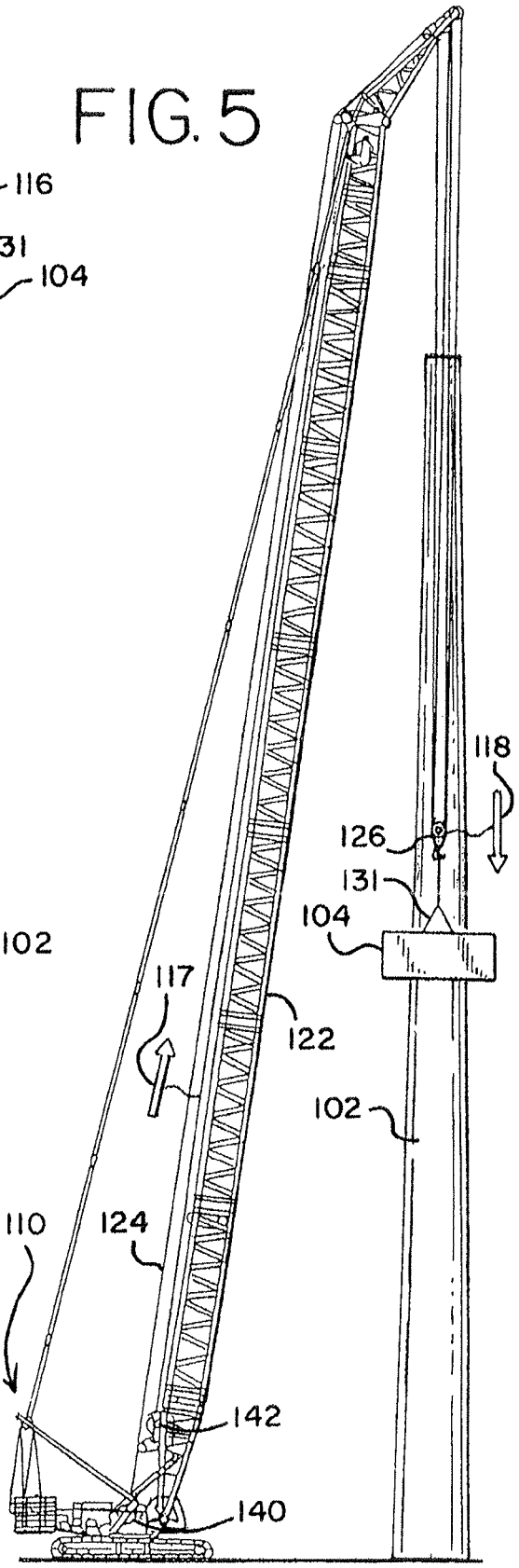
FIG. 5 is a side elevational view of the crane of FIG. 2, showing the hook block and object being lowered to the ground.
Figure 6:
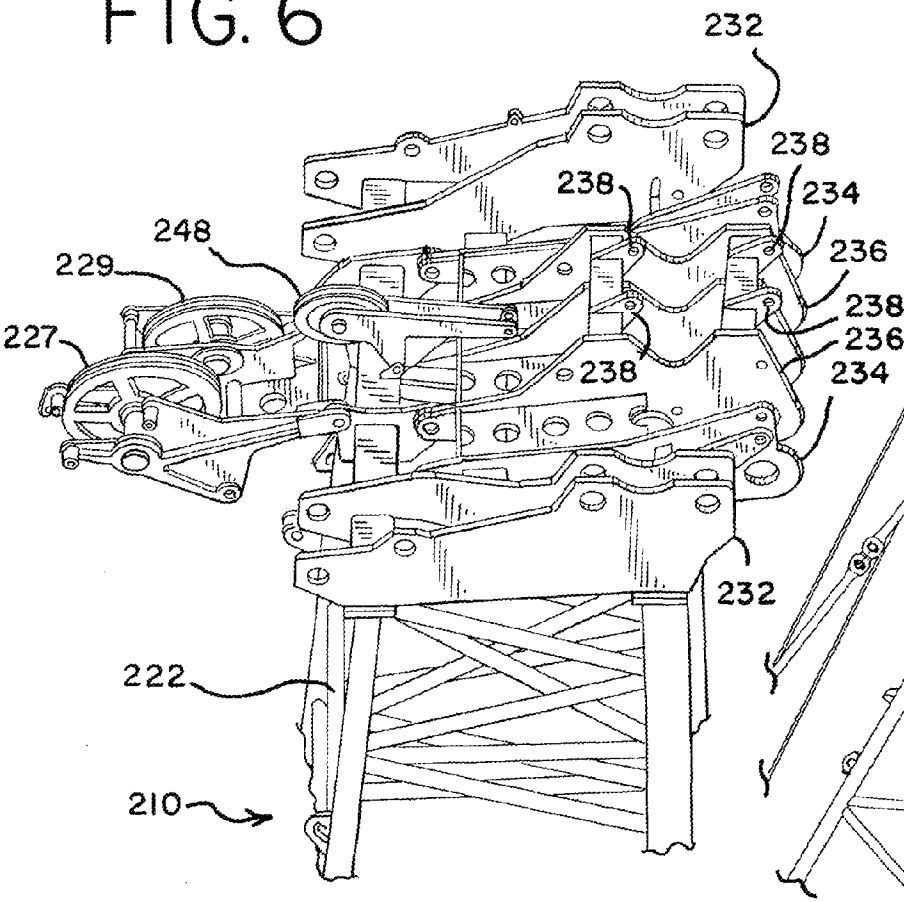
FIG. 6 is a perspective view a third embodiment of a mobile lift crane utilizing the drum tensioning apparatus and method of the present invention, showing just the boom top.

Finally, as shown in FIG. 5, the nacelle 104 can be lowered to the ground. This is done by unwinding load hoist line 124 that is wrapped around the first drum 142, shown by arrow 117, whereby the hook block and the object are lowered, shown by arrow 118. In this step drum 140 is held stationary.

FIGS. 6 and 7 show details of the top portion of a crane 210 that is particularly suited for performing the method of the present invention. In FIG. 6 the brackets on the top of boom 222 are shown without the sheaves or upper boom point attached for sake of clarity. FIG. 7 shows an upper boom point 223 with a pulley 246, and boom top sheaves 244, attached to the brackets.

The brackets on the boom top of FIG. 6 include two sets of female brackets 232 used for connecting a luffing jib (not shown) or an extended upper boom point onto the top of boom 222, and brackets 234 that mount a frame that holds the sheaves 244 of the lower boom point when an extended upper boom point is not used. Brackets 236 support lugs that each contain holes 238 to which the upper boom point 223 may be connected. FIG. 6 also shows the wire rope guides 227, 229, and a load sensing sheave 248 that are mounted to the top of boom 222. These are shown in their operational position, and are connected with a pin connection so that they can be folded forward into a stowed position when the boom top is transported between job sites.

FIG. 7 shows the continuous reeving of load hoist line 224 and how the load sensing sheave 248 is used. The line 224 comes from a first drum on the rotating bed (not shown) up to the first wire rope guide 227, and passes over pulley 246 on upper boom point 223. From there the load hoist line 224 passes to the sheaves in hook block 226, and is reeved using multiple parts of line with the sheaves 244 in the lower boom point. The last part of line passes from the sheaves 244 over the load sensing sheave 248 and the wire rope guide 229 before passing down to a drum mounted on the boom (not shown). It can be seen that the tension in load hoist line 224 will push the sheave 248 downwardly with a force that is directly proportional to the tension in the line 224. A sensor built into the load sensing sheave support in a conventional manner (not shown) then provides a signal as an input (either directly or through an interface) to the computer processor.

FIGS. 8 and 9 show the top portion of crane 310, which is just like crane 210 except that an extended upper boom point 323 is attached to the brackets 332. While wire rope guides 327 and 329 are still attached to the brackets on the top of the boom 322, the load sensing sheave 348 is attached to the extended upper boom point 323. The extended upper boom point 323 includes sheaves 344 and 346 through which load hoist line 324 is continuously reeved with the sheaves in hook block 326.

In addition to moving an object from a high elevation to the ground, the present method can be used to tightly spool rope onto a drum where objects are lowered from the elevation of the crane to a lower elevation, such as into the shaft of a tunnel. Since the invention has application to cranes other than mobile crawler cranes that traverse the ground, such as a platform crane on a deep sea oil rig, it is helpful to compare the elevations from which objects are being picked up and to which objects are being lowered not with reference to the ground elevation, but with reference to the elevation of the plane of the connection between i) a lowerworks comprising ground engaging members of the crane, such as carbody 12, and ii) an upperworks rotatably connected to the lowerworks such that the upperworks can swing with respect to the lowerworks, such as the rotating bed 20. For lifts like moving the nacelle 104, this plane is essentially at the elevation of the ground. Thus, in some operations, such as that depicted in FIGS. 2-5, the object is at an elevation above the connection between the crane upperworks and the crane lowerworks at the beginning of the lift, and is lowered to an elevation adjacent the connection between the upperworks and the lowerworks, whereas at other times the object is lowered to an elevation below the connection between the upperworks and the lowerworks.

One of the basic steps in the preferred process of the invention is to limit movement of the hook block while applying the winding and hold back forces, thus transferring wire rope from one drum to the other. If the movement of the hook block were not limited in this step, with the hold back force being applied to the second drum, when the wire rope was wound onto the first drum, the hook block would be drawn closer to the boom top rather than the wire rope coming off of the second drum. It should be noted that the hook block does not need to be completely stationary in this step, but its movement must be limited. In addition to attaching the hook block to the object to be lifted, there are several other methods contemplated for limiting the movement of the hook block. First, the hook block may be attached to an object different than the object to be lifted in order to limit movement of the hook block. For example, a piece of crane counterweight may be used. With this first alternate method, the object may remain on the ground (or some other support) during the tensioning operation (which will occur when the object weighs more than the lift force generated when the desired line pull tension is put on the load hoist line for the tensioning step), or the object may be lifted and suspended at a nearly constant elevation during the operation of spooling load hoist line under tension from the second drum to the first drum. If the object is lifted, then the tension with which the load hoist line is wound onto the first drum will be based on the weight of the object, and the hold back and wind-up forces must be controlled to make sure that the object is not raised too high. These first alternate methods may be particularly useful in operations where the load hoist line is used to lower an object into a shaft of a tunnel after the load hoist line has been spooled under tension onto the first drum. In such operations, the boom may be fairly short, and the hook block will not need to be very high up in the air during the tensioning operation.

A second method of limiting the movement of the hook block is to attach the hook block to an object that is effectively immovable by the crane, in contrast to an object that could be lifted by the crane but would require higher tension in the load hoist line than is desirable for the tensioning operation. Thus the hook block may be attached to an object that is so heavy that the crane cannot lift it, or to a member that is secured to the ground in such a fashion that the crane cannot detach it from the ground. The radius of the load from the tipping fulcrum of the crane is taken into account in this method, such that the load moment generated by the weight of the object, or the force that would be required to detach the object from the ground, could be so large that the crane would tip before the object were lifted or detached.

A third alternative method by which movement of the hook block is limited is to raise the hook block to a position where the hook block is prevented from being raised further by interference with the boom top. In this method, a spacer may be placed between the hook block and the boom top as the hook block is raised to the interfering position, the spacer being configured to protect components of the hook block and boom top from damaging each other while the load hoist line is spooled from the second drum to the first drum. FIGS. 8 and 9 show this feature. The crane 310 is fitted with a frame 342 that acts as a spacer. In practicing the method of the invention, the hook block 326 is raised until it comes into contact with frame 342, as shown in FIG. 9. It is maintained in this position while the load hoist line is spooled from one drum to another while a hold back force is applied. The frame 342 is constructed sufficiently sturdy so that the forces created by the hold back and winding tension in the multiple parts of line 324 do not crush the frame. The frame may stay attached to the boom top throughout the crane operation. Alternatively, the frame could be attached to the top of the hook block, in which case it could be attached while the hook block was close to the ground. In that case it would stay attached during the tensioning operation and while the load was lowered from a high elevation to the ground, and could then be removed after the object was taken off the hook if another tensioning operation was not going to immediately follow.

A fourth alternative method to limit movement of the hook block is to attach the hook block to another part of the crane. For instance, a beam between the crawler frames could be outfitted with a tie off point to which the hook block could be attached to limit its movement during the tensioning operation.

There are several conditions within the crane that can be sensed that relate to the tension in the load hoist line. For example, hydraulic pressure of hydraulic fluid used to torque a motor to turn the first drum (along with an indication of which layer of rope is on the drum) may be sensed and used to provide information about the lead line pull. When the boom is supported by a boom suspension, the crane may be provided with load pin in the boom suspension (see FIG. 3)for measuring tension in the boom suspension, and the measured tension is used (along with information on the boom angle and the number of parts of line in the hook block rigging) to provide information about the lead line pull. If the movement of the hook block is limited by attaching the hook block to an object, and the crane is provided with load sensor in the hook block (see FIG. 7), that load pin sensor may be used to provide information about the lead line pull. Alternatively, a load sensor may be provided in rigging attaching the hook block to the object (see FIG. 3), and that load sensor may then used to provide information about the lead line pull. The load sensors may be in the form of a load link, a load pin or some other form of load cell as appropriate.

As noted previously, information from which the lead line pull in the load hoist line may be calculated is preferably collected during the spooling operation, and the information is used to maintain the line pull in a range between about 5% and about 25% of the rated line pull during the spooling operation.

The preferred steps used by a crane operator in practicing the invention are as follows. The operator controls drum one to pull the hook block to the stop position. As noted above, the stop position can be attaching the block to the object to be lifted, or to another object or the crane itself, or bringing the block to a spacer attached to the boom top. Next the operator selects the rope tensioning mode within the control program, described below in connection with FIG. 12. The computer controller would then engage drum two and pull the rope from drum one onto drum two. At the direction of the control program, drum one will "hold back" the rope and provide the desired tension as the rope is spooled onto drum two. When the operator determines that a sufficient length of load hoist line has been transferred, or when the bail limit sensor indicates that the maximum amount of line has been spooled off of drum one, the operator then selects the normal hoisting mode operation and operates normally from drum two to attach and lower the object. The routine may end prior to reaching the bail limits. Once the rope on drum one is down to the first layer, it will be in a good position to wind rope under tension while lifting back onto it if needed. The bail limit is primarily there to ensure that the drum is not unspooled to the dead end.

FIG. 12 shows a flowchart of a first computer program subroutine that may be used to allow a crane operator to practice the method of the invention. When the subroutine is started, the program first inquires at block 71 whether the rope tensioning mode is enabled. If not, the crane continues to operate with standard logic for controlling the pumps, motors and brakes on the drums 40 (block 76) and the subroutine ends. The subroutine is frequently repeated (for example, every 30 milliseconds), so as soon as the rope tensioning mode is enabled by the operator, the block 71 condition is satisfied and at block 72 the program inquires whether either drum parking switch is open, meaning that the operator has used a switch on the console to indicate whether the drum is to be used. If the switch is open, meaning there is an open circuit, that indicates that the drum is not going to be used, and the drum is "parked". If neither parking switch is open, at block 73 the program inquires whether only one drum has handle command, meaning that it is moved off of its neutral position, indicating that the operator is trying to make the drum rotate. If so, at block 74 the program inquires whether the handle command is less than zero, meaning that a signal is directing a hoist-down operation, in which wire rope is spooled off the drum. If the handle command is less than zero, or if the condition in block 73 is not met, or if either drum parking switch is open at block 72, the program reads the actual line tension, which is used to determine if the current tension meets the 5-25% of rated line pull target. This actual tension is written at block 75 into memory to be used in block 81 and the crane continues to use standard logic at block 76 and the subroutine ends.

If only one drum has handle command, and the handle command is not less than zero at block 74 (meaning that the controls are signaling an operation that spools wire rope onto the drum), the program inquires at block 77 whether either drum has operating limits, such as anti-two block (ATB), bail limits, or load moment. If so, an alert is sent to the operator and the pump, motor and brakes are set to a safe state at block 86 (the pump goes to zero output, the motor is set to maximum displacement and the brake is set to be on) and the subroutine ends. However, if no operating limits are in effect at block 77, the subroutine inquires at block 78 whether the brakes for both drums are released. If not, the motor is adjusted (stroked) to maximum displacement at block 84 and pressure feedback is used for pump controls at block 85 until pressure memory criteria are met and the subroutine ends. Of course the subroutine will immediately be run again, and this time the brakes will be in a released state as the pressure memory criteria are met.

If brakes on both drums are in a released state at block 78, then the subroutine will proceed with a rope tensioning operation. At block 79 the drum with handle command is set as the drum to be spooled, and the other drum is set as the hold back drum. At block 80 pressure feedback is used to drive each motor to the target motor position (minimum displacement), which maximizes speed and provides maximum controllability by maintaining a constant motor displacement. The subroutine at block 81 reads the tension that was written at block 75 and evaluates whether it is in the target limits (5%-25% of rated line pull). If not, at block 82 the tension target is calculated, meaning that line tension is increased or decreased, or otherwise manipulated, so that it is brought within the limits. If so, or once the tension target is calculated, at block 83 the program controls the pump commands to maintain the desired line tension. The rope tensioning sequence will continue until the operator returns the hoist control handle to neutral, there is a state change in any of the inputs, or the bail limit is reached. The subroutine outlined in the flowchart is called repetitively. Therefore, if there is a change in the input of any decision block, the flow of the program and resulting outputs could change with every subroutine call. The spooling operation can thus end by a state change in any of the inputs (e.g. parking switches, handle, operating limits, including bail limit, etc.).

FIG. 13 shows a flowchart of a second computer program subroutine that may be used to allow a crane operator to practice the method of the invention. The subroutine of FIG. 13 is very similar to the subroutine of FIG. 12. The major differences represent two changes to the operator interface that were made to make the system more user friendly. In the flow chart of FIG. 12, the line tension desired while transferring rope from one load drum to the other was continuously updated while only one of the two load drums was active. For the flowchart of FIG. 13, the desired line tension is treated as an operator input through a display screen (not shown) prior to the subroutine being run. Therefore, any mention of updating the tension was removed from the second flowchart. Secondly, the flow chart of FIG. 12 specified that the rope tensioning control was only active if the handle was >0, meaning that the intended drum was being spooled and the opposite drum would be the hold back drum. In the flow chart of FIG. 13, the handle can be actuated in either direction and the control system will recognize the intended movement, and assign the spooled drum and the hold back drum appropriately.

When the subroutine of FIG. 13 is started, the program first inquires at block 171 whether the rope tensioning mode is enabled. If not, the crane continues to operate with standard logic for controlling the pumps, motors and brakes on the drums 40 (block 176) and the subroutine ends. However, as soon as the rope tensioning mode is enabled by the operator, the block 171 condition is satisfied and at block 172 the program inquires whether either drum parking switch is open. If not, at block 173 the program inquires whether only one drum has handle command. If the condition in block 173 is not met, or if either drum parking switch is open at block 172, the crane continues to use standard logic at block 176 and the subroutine ends.

If only one drum has handle command, the program inquires at block 177 whether either drum has operating limits. If so, an alert is sent to the operator and the pump, motor and brakes are set to a safe state at block 186 and the subroutine ends. However, if no operating limits are in effect at block 177, the subroutine inquires at block 178 whether the brakes for both drums are released. If not, the motor is adjusted (stroked) to maximum displacement at block 184 and pressure feedback is used for pump controls at block 185 until pressure memory criteria are met and the subroutine ends. Of course the subroutine will immediately be run again, and this time the brakes will be in a released state as the pressure memory criteria are met.

If brakes on both drums are in a released state at block 178, then the subroutine will proceed with a rope tensioning operation. At block 179 the handle command is used to determine which drum is to be spooled and which drum will be the hold back drum. At block 180 pressure feedback is used to drive each motor to the target motor position. At block 183 the program controls the pump commands to maintain the desired line tension, which was input by the operator before the rope tensioning sequence was begun. The computer thus controls the pump to produce the desired tension. As with the subroutine in FIG. 12, the rope tensioning sequence will continue until the operator returns the hoist control handle to neutral, there is a state change in any of the inputs, e.g. parking switches are opened, or the bail limit is reached.

Several aspects of the embodiments described are illustrated as software modules or components. As used herein, a software module or component may include any type of computer instruction or computer executable code located within a memory device and/or transmitted as electronic signals over a system bus or wired or wireless network. A software module may, for instance, include one or more physical or logical blocks of computer instructions, which may be organized as a routine, program, object, component, data structure, etc. that performs one or more tasks or implements particular abstract data types.

In certain embodiments, a particular software module may include disparate instructions stored in different locations of a memory device, which together implement the described functionality of the module. Indeed, a module may include a single instruction or many instructions, and it may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices.

The disclosed embodiments may include various steps, which may be embodied in machine-executable instructions to be executed by a general-purpose or special-purpose computer (or other electronic device). Alternatively, the steps may be performed by hardware components that contain specific logic for performing the steps, or by any combination of hardware, software, and/or firmware. Embodiments may also be provided as a computer program product including a machine or computer-readable medium having stored thereon instructions that may be used to program a computer (or other electronic device) to perform processes described herein. The machine or computer-readable medium may include, but is not limited to, floppy diskettes, optical disks, CD-ROMs, DVD-ROMs, ROMs, RAMs, EPROMs, EEPROMs, magnetic or optical cards, propagation media or other type of media/machine-readable medium suitable for storing electronic instructions. For example, instructions for performing described processes may be transferred from a remote computer (e.g., a server) to a requesting computer (e.g., a client) by way of data signals embodied in a carrier wave or other propagation medium via a communication link (e.g., network connection).

The present invention is advantageous in that it solves the problems associated with lowering heavy loads with long lengths of loosely spooled wire rope on the drum. The method can be practiced without frictionally engaging the wire rope between brake blocks or other devices that would tend to cause frictional wear in the rope, and without adding extra bending motions in the travel path of the rope. Also, the invention can be utilized with very few additional components other than what are normally on a crane. In fact, as long as the crane has two drums so that the load hoist line can be continuously reeved, the method can be practiced with minimal modification to the crane, such as the addition of rope guides to get the two ropes continuously reeved properly over the boom point. Other minimal modifications to practice a preferred embodiment of the invention include bail limits and a load sensing sheave. A computer program may be used to synchronize drum operation during the spooling operation. If a sensor is available on the crane that senses a condition that is related to the tension in the load hoist line, the method can be practiced using a computer processor running a novel subroutine to assist with maintaining the proper tension as the load hoist line is spooled from one drum to the other. This allows existing cranes to be easily adapted so that they can be used to practice the present invention.

It should be understood that various changes and modifications to the presently preferred embodiments described herein will be apparent to those skilled in the art. For example, many other lift operations could utilize the present invention, such as using the load hoist line that has been spooled under tension to lower a distillation column that is being taken down. Also, the invention can be used on other types of cranes, such as tower cranes, truck mounted cranes, telescoping cranes and other lattice cranes. Such changes and modifications can be made without departing from the spirit and scope of the present invention and without diminishing its intended advantages. It is therefore intended that such changes and modifications be covered by the appended claims.

The invention claimed is:

1. A method of operating a crane having a continuously reeved load hoist line, with a first end of the load hoist line connected to a first drum and a second end of the load hoist line connected to a second drum, with the load hoist line reeved through boom sheaves and a hook block, the method comprising:

a) applying a hold-back force to the second drum;

b) applying a winding force to the first drum greater than the hold back force on the second drum; and c) applying said winding and hold back forces while limiting movement of the hook block, thereby spooling multiple layers of the load hoist line from the second drum through the boom sheaves and hook block and onto the first drum while maintaining tension in the load hoist line such that the load hoist line is wound under more tension in multiple layers on the first drum than the load hoist line had previously been wound on the second drum;

d) wherein the load hoist line is unwound from the second drum while the load hoist line is simultaneously wound onto the first drum.

2. The method of claim 1 wherein the movement of the hook block is limited in step c) by attaching the hook block to an object.

3. The method of claim 2 wherein the crane comprises i) a lowerworks comprising ground engaging members and ii) an upperworks rotatably connected to the lowerworks such that the upperworks can swing with respect to the lowerworks, and the object is at an elevation above the connection between the upperworks and the lowerworks during step c), and wherein, after spooling load hoist line from the second drum to the first drum, the method further comprises the steps of:

d) lifting an object; and e) then unwinding load hoist line that is wound around the first drum, whereby the hook block and the object are lowered to an elevation adjacent the connection between the upperworks and the lowerworks.

4. The method of claim 2 wherein prior to steps a), b) and c), the hook block is raised to an elevation at which the hook block can be attached to the object by winding the load hoist line onto the second drum while the hook block has substantially no load on the hook block and wherein the load hoist line has a rated line pull and the tension on the load hoist line as the hook block is being raised prior to steps a), b) and c) is less than 5% of the rated line pull.

5. The method of claim 1 further comprising the steps, after spooling load hoist line from the second drum to the first drum, of d) lifting an object and e) then unwinding load hoist line that is wound around the first drum, whereby the hook block and the object are lowered.

6. The method of claim 5 wherein the hook block is also attached to the object to limit movement of the hook block in step c).

7. The method of claim 5 wherein the hook block is attached to an object different than the object to be lifted in order to limit movement of the hook block in step c).

8. The method of claim 5 wherein the crane comprises i) a lowerworks comprising ground engaging members and ii) an upperworks rotatably connected to the lowerworks such that the upperworks can swing with respect to the lowerworks, and the object is lowered to an elevation below the connection between the upperworks and the lowerworks during step e).

9. The method of claim 1 wherein the boom sheaves are mounted on a boom top, and the movement of the hook block is limited by raising the hook block to a position where the hook block is prevented from being raised further by interference with the boom top, and wherein a spacer is placed between the hook block and the boom top as the hook block is raised to the interfering position, the spacer being configured to protect components of the hook block and boom top from damaging each other while the load hoist line is spooled from the second drum to the first drum.

10. The method of claim 1 wherein the load hoist line has a rated line pull, and the load hoist line is spooled onto the first drum in step c) with a tension that is between about 5% and about 25% of the rated line pull.

11. The method of claim 1 wherein information from which a lead line pull in the load hoist line is calculated is collected during the spooling operation, and the information is used to maintain the line pull in a range between about 5% and about 25% of the rated line pull during the spooling operation.

12. The method of claim 11 wherein the information from which the lead line pull is calculated is selected from the group consisting of:

i) the load hoist line is routed from the first drum, over a load sheave, and around the second drum, and the load sheave provides information about the lead line pull;

ii) the hydraulic pressure of hydraulic fluid used to torque a motor to turn the first drum is sensed and used to provide information about the lead line pull;

iii) the boom is supported by a boom suspension, and the crane is provided with load pin in the boom suspension for measuring tension in the boom suspension, and the measured tension is used to provide information about the lead line pull;

iv) the movement of the hook block in step c) is limited by attaching the hook block to an object and the crane is provided with a load sensor in the hook block, and the load sensor is used to provide information about the lead line pull; and v) the movement of the hook block in step c) is limited by attaching the hook block to an object, and a load sensor is provided in rigging attaching the hook block to the object, and the load sensor is used to provide information about the lead line pull.

13. The method of claim 1 wherein the hold-back force on the second drum is provided by a means selected from the group consisting of a hydraulic motor and a mechanical brake.

14. A crane comprising:

a) a lowerworks having ground engaging members;

b) upperworks rotatably connected to the lowerworks such that the upperworks can swing with respect to the ground engaging members;

c) a boom pivotally mounted at a first end on the upperworks;

d) a load hoist line connected at a first end of the load hoist line to a first drum on the crane and connected at a second end of the load hoist line to a second drum on the crane, with the load hoist line reeved through sheaves at a second end of the boom and through sheaves in a hook block suspended from the boom;

e) a sensor on the crane that senses a condition that is related to the tension in the load hoist line;

f) a computer processor coupled with the sensor, the computer processor operable to control at least some operations of the crane; and g) a computer readable storage medium comprising programming code embodied therein operable to be executed by the computer processor to receive signals from the sensor indicating the condition related to the load hoist line tension and to control a winding force applied to the first drum and controlling the spooling of the load hoist line from the second drum onto the first drum, wherein said spooling involves the simultaneous transfer of multiple layers of load hoist line off of the second drum and multiple layers of load hoist line onto the first drum.

15. The crane of claim 14 wherein the winding force applied to the first drum is controlled to spool the load hoist line from the second drum onto the first drum with a tension in a predetermined tension range, the predetermined tension range being determined before the winding force is applied, and wherein the load hoist line has a rated line pull and the predetermined tension range is contained with the range of about 5% and about 25% of the rated line pull of the load hoist line.

16. The crane of claim 14 wherein the sensor comprises a load sensing sheave over which the load hoist line passes, and the sensor measures the tension in the load hoist line by sensing the compressive force applied to the load sensing sheave by the load hoist line, and wherein the load sensing sheave is mounted on the second end of the boom.

17. The crane of claim 14 wherein the crane is a mobile lift crane and the ground engaging members comprise moveable ground engaging members, and wherein the first drum and second drum are each equipped with a bail limit sensor.

18. The crane of claim 14 wherein the winding force is generated by a hydraulic motor connected to a pressurized source of hydraulic fluid, and the computer readable program code is adapted to be executed to control the pressure of the hydraulic fluid supplied to the hydraulic motor.

19. The crane of claim 14 wherein the load hoist line comprises wire rope with die-compacted outer strands, and wherein the load hoist line comprises wire rope with a uniform diameter throughout its length from its first end connected to the first drum to its second end connected to the second drum.

20. The crane of claim 14 wherein the computer program code is further adapted to cause a hold back force on the second drum while the load hoist line is spooled from the second drum onto the first drum.

* * * * *